US009246262B2

(12) United States Patent
Brown et al.

(10) Patent No.: US 9,246,262 B2
(45) Date of Patent: Jan. 26, 2016

(54) ELECTRICAL CONNECTOR INCLUDING LATCH ASSEMBLY WITH PULL TAB

(71) Applicants: Robert W. Brown, Harrisburg, PA (US); Robert E. Marshall, Elizabethtown, PA (US)

(72) Inventors: Robert W. Brown, Harrisburg, PA (US); Robert E. Marshall, Elizabethtown, PA (US)

(73) Assignee: FCI AMERICAS TECHNOLOGY LLC, Carson City, NV (US)

( * ) Notice: Subject to any disclaimer, the term of this patent is extended or adjusted under 35 U.S.C. 154(b) by 50 days.

(21) Appl. No.: 13/947,547

(22) Filed: Jul. 22, 2013

(65) Prior Publication Data

US 2014/0038447 A1 Feb. 6, 2014

Related U.S. Application Data

(60) Provisional application No. 61/680,138, filed on Aug. 6, 2012.

(51) Int. Cl.

| | |
|---|---|
| ***H01R 13/627*** | (2006.01) |
| ***H01R 13/62*** | (2006.01) |
| ***H01R 13/633*** | (2006.01) |

(52) U.S. Cl.

CPC ..... *H01R 13/62* (2013.01); *H01R 13/6275* (2013.01); *H01R 13/6335* (2013.01)

(58) Field of Classification Search

CPC ..... H01R 13/6275; H01R 13/6272; H01R 13/627

USPC ..... 439/350, 352, 358, 483

See application file for complete search history.

(56) References Cited

U.S. PATENT DOCUMENTS

| | | | |
|---|---|---|---|
| 5,062,803 | A | 11/1991 | Howard et al. |
| 5,211,572 | A | 5/1993 | Comstock et al. |
| 5,564,939 | A | 10/1996 | Maitani et al. |
| 5,779,495 | A | 7/1998 | Dechelette et al. |
| 6,447,170 | B1 | 9/2002 | Takahashi et al. |
| 6,648,666 | B1 | 11/2003 | Wu |
| 6,746,264 | B1 | 6/2004 | Branch et al. |
| 6,758,699 | B1 | 7/2004 | Hwang et al. |
| 6,786,653 | B1 | 9/2004 | Hwang et al. |
| 6,953,356 | B2 | 10/2005 | Hisamatsu et al. |
| 7,134,914 | B1 | 11/2006 | Wu |
| 7,160,135 | B1 | 1/2007 | Wu |

(Continued)

FOREIGN PATENT DOCUMENTS

| | | |
|---|---|---|
| EP | 1477834 | 11/2004 |
| EP | 1855133 | 11/2007 |

*Primary Examiner* — Hae Moon Hyeon

(74) *Attorney, Agent, or Firm* — Baker & Hostetler LLP

(57) ABSTRACT

An electrical connector can includes a connector housing that includes a housing body and further includes at least one fulcrum supported by the housing body. The electrical connector further includes at least one electrical contact supported by the connector housing, the at least one electrical contact configured to mate with a complementary electrical contact of a complementary electrical connector. The electrical connector further includes a latch assembly. The latch assembly can include an actuator and a latch. The actuator can have an actuator portion, an attachment portion, and at least one arm that extends between the actuator portion and the attachment portion. The latch can have a latch body that defines an attachment portion that is configured to be attached to the attachment portion of the actuator, such that movement of the actuator in a predetermined direction causes the pivot member to ride along the fulcrum, thereby pivoting the latch from a latched position to an unlatched position.

28 Claims, 15 Drawing Sheets

(56) References Cited

U.S. PATENT DOCUMENTS

| | | | | |
|---|---|---|---|---|
| 7,163,413 | B2 | 1/2007 | Murayama | |
| 7,281,937 | B2 | 10/2007 | Reed et al. | |
| 7,322,845 | B2 | 1/2008 | Regnier et al. | |
| 7,354,292 | B1 | 4/2008 | Lloyd et al. | |
| 7,371,117 | B2 | 5/2008 | Gailus | |
| 7,442,047 | B1 | 10/2008 | Schmidgall | |
| 7,445,484 | B2 * | 11/2008 | Wu | 439/352 |
| 7,476,117 | B1 | 1/2009 | Chen et al. | |
| 7,494,363 | B1 * | 2/2009 | Wu | 439/352 |
| 7,527,522 | B2 | 5/2009 | Kondou | |
| 7,540,755 | B1 * | 6/2009 | Wu | 439/352 |
| 7,559,785 | B1 * | 7/2009 | Wu | 439/352 |
| 7,572,138 | B1 * | 8/2009 | Wu | 439/352 |
| 7,651,361 | B2 | 1/2010 | Henry et al. | |
| 7,666,023 | B2 * | 2/2010 | Wu | 439/352 |
| 7,736,171 | B2 | 6/2010 | Reed et al. | |
| 7,753,710 | B2 | 7/2010 | George | |
| 7,845,859 | B2 | 12/2010 | Roth et al. | |
| 7,938,669 | B2 * | 5/2011 | Li et al. | 439/352 |
| 8,202,122 | B2 * | 6/2012 | Wu | 439/607.47 |
| 8,241,045 | B2 | 8/2012 | Reed et al. | |
| 8,475,198 | B2 * | 7/2013 | Wu | 439/352 |
| 8,585,426 | B2 * | 11/2013 | Zerebilov et al. | 439/370 |
| 8,787,025 | B2 * | 7/2014 | Wu | 361/740 |
| 2005/0048830 | A1 | 3/2005 | Li et al. | |
| 2005/0233631 | A1 | 10/2005 | Wu | |
| 2005/0255736 | A1 | 11/2005 | Szczesny | |
| 2007/0004282 | A1 | 1/2007 | Cohen et al. | |
| 2009/0042431 | A1 | 2/2009 | Herring et al. | |
| 2009/0221165 | A1 | 9/2009 | Buck et al. | |
| 2009/0291593 | A1 | 11/2009 | Atkinson et al. | |
| 2010/0144187 | A1 | 6/2010 | Chapel et al. | |
| 2012/0058665 | A1 | 3/2012 | Zerebilov et al. | |

* cited by examiner

ELECTRICAL CONNECTOR INCLUDING LATCH ASSEMBLY WITH PULL TAB

CROSS-REFERENCE TO RELATED APPLICATIONS

This claims the benefit of U.S. Provisional Patent Application Ser. No. 61/680,138 filed Aug. 6, 2012, the disclosure of which is hereby incorporated by reference as if set forth in its entirety herein.

BACKGROUND

Electrical connectors include a connector housing that carries a plurality of electrical contacts configured to electrically connect a pair of electrical components. For instance, the electrical contacts can electrically connect to a cable at one end, and can mate with a complementary electrical connector at a mating end, thereby placing the complementary electrical connector in electrical communication with the cable. In some instances, for example when the complementary electrical connector is mounted onto a printed circuit board or backpanel, conventional electrical connectors include a latch that is coupled to the connector housing, and configured to removably secure the electrical connector to the complementary electrical connector so as to prevent the electrical connectors from inadvertently becoming unmated.

SUMMARY

In accordance with one embodiment, an electrical connector includes a connector housing that includes a housing body and further includes at least one fulcrum supported by the housing body. The electrical connector further includes at least one electrical contact supported by the connector housing, the at least one electrical contact configured to mate with a complementary electrical contact of a complementary electrical connector. The electrical connector further includes a latch assembly. The latch assembly can include an actuator and a latch. The actuator can have an actuator portion, an attachment portion, and at least one arm that extends between the actuator portion and the attachment portion. The latch can have a latch body that defines an attachment portion that is configured to be attached to the attachment portion of the actuator, a latch portion, and at least one pivot member disposed between the attachment portion and the latch portion. The latch body further includes a latch member that extends from the latch portion toward the connector housing. When the attachment portion of the actuator is attached to the attachment portion of the latch, movement of the actuator in a predetermined direction causes the pivot member to ride along the fulcrum, thereby pivoting the latch from a latched position to an unlatched position.

BRIEF DESCRIPTION OF THE DRAWINGS

The foregoing summary, as well as the following detailed description of an example embodiment of the application, will be better understood when read in conjunction with the appended drawings, in which there is shown in the drawings an example embodiment for the purposes of illustration. It should be understood, however, that the application is not limited to the precise arrangements and instrumentalities shown. In the drawings.

DETAILED DESCRIPTION

Figure 1:
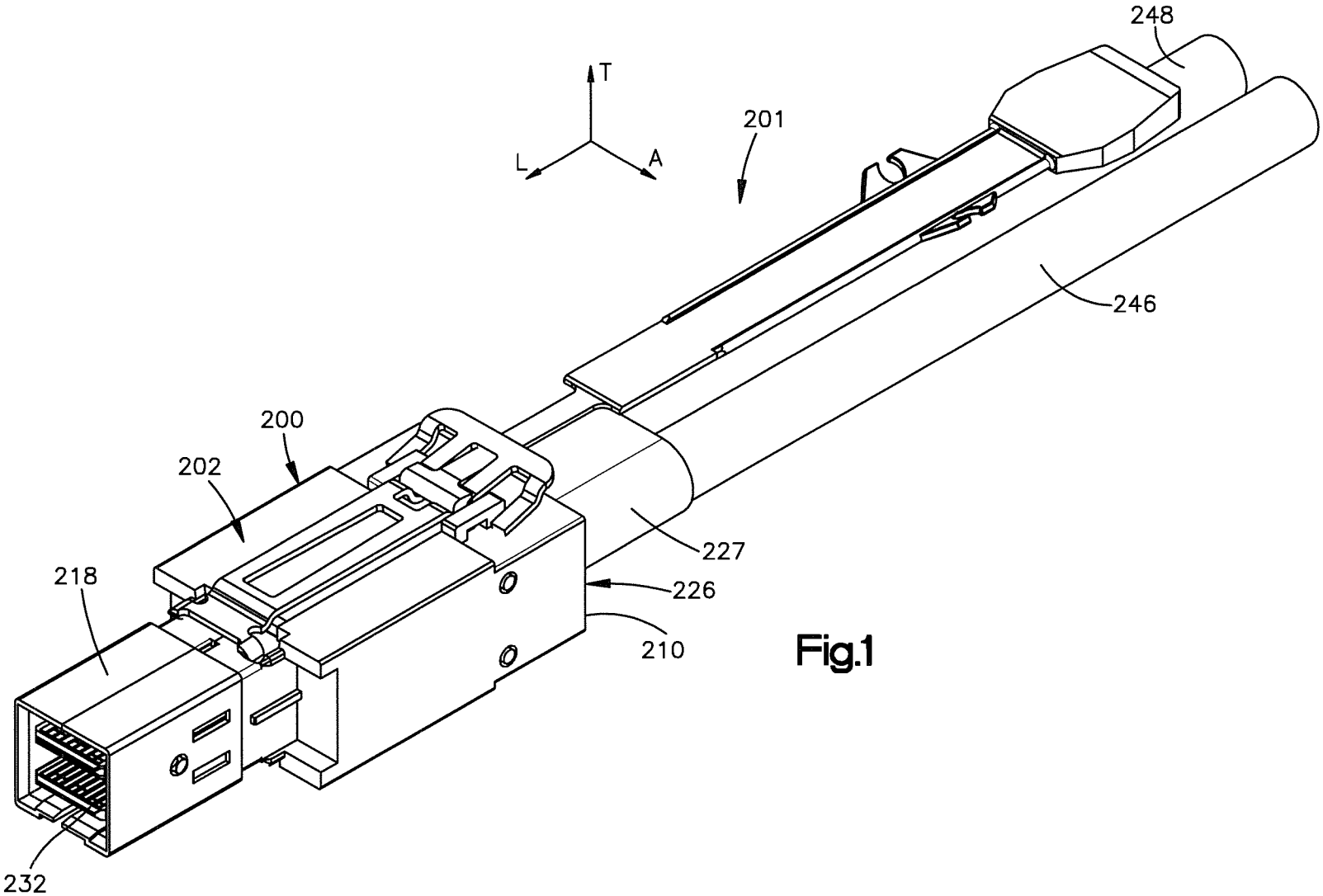
FIG. 1 is a perspective view of an electrical connector coupled to a pair of cables, constructed in accordance with an embodiment.

Referring to FIGS. 1-14B in general, an electrical connector includes a latch assembly including a latch and an actuator that is configured to actuate the latch between a latched position and an unlatched position. The electrical connector can be configured as a cable connector having a low profile housing, and mounting ends that are spaced horizontally from each other, and thus electrically connect with cables that are spaced horizontally from each other. The latch assembly is supported by an upper surface of the housing.

For convenience, the same or equivalent elements in the various embodiments illustrated in the drawings have been identified with the same reference numerals. Certain terminology is used in the following description for convenience only and is not limiting. The words "left," "right," "front,"

"rear," "upper," and "lower" designate directions in the drawings to which reference is made. The words "forward," "forwardly," "rearward," "inner," "inward," "inwardly," "outer," "outward," "outwardly," "upward," "upwardly," "downward," and "downwardly" refer to directions toward and away from, respectively, the geometric center of the object referred to and designated parts thereof. The terminology intended to be non-limiting includes the above-listed words, derivatives thereof and words of similar import.

Figure 2:
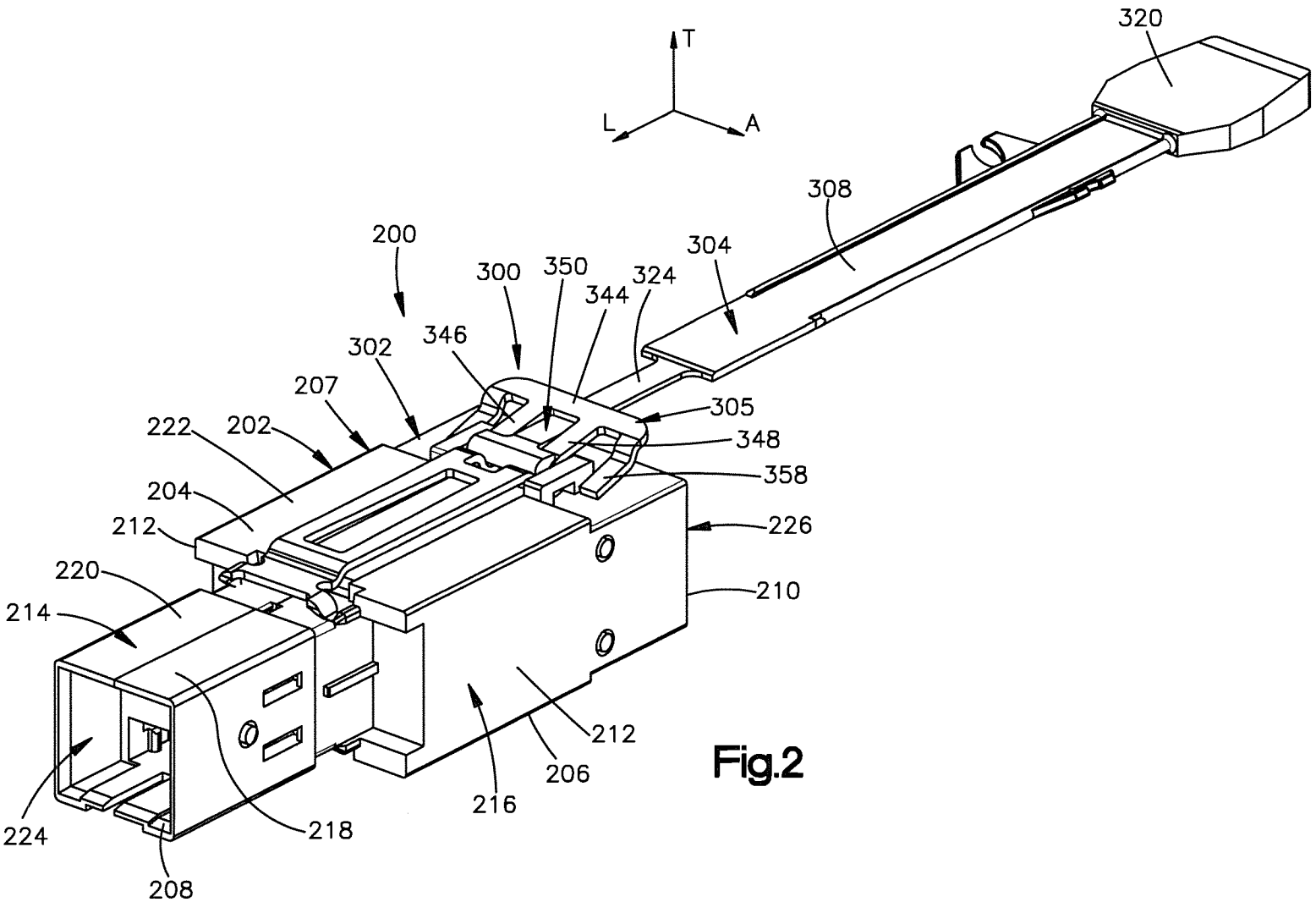
FIG. 2 is an isolated view of the electrical connector illustrated in FIG. 1.
Figure 3:
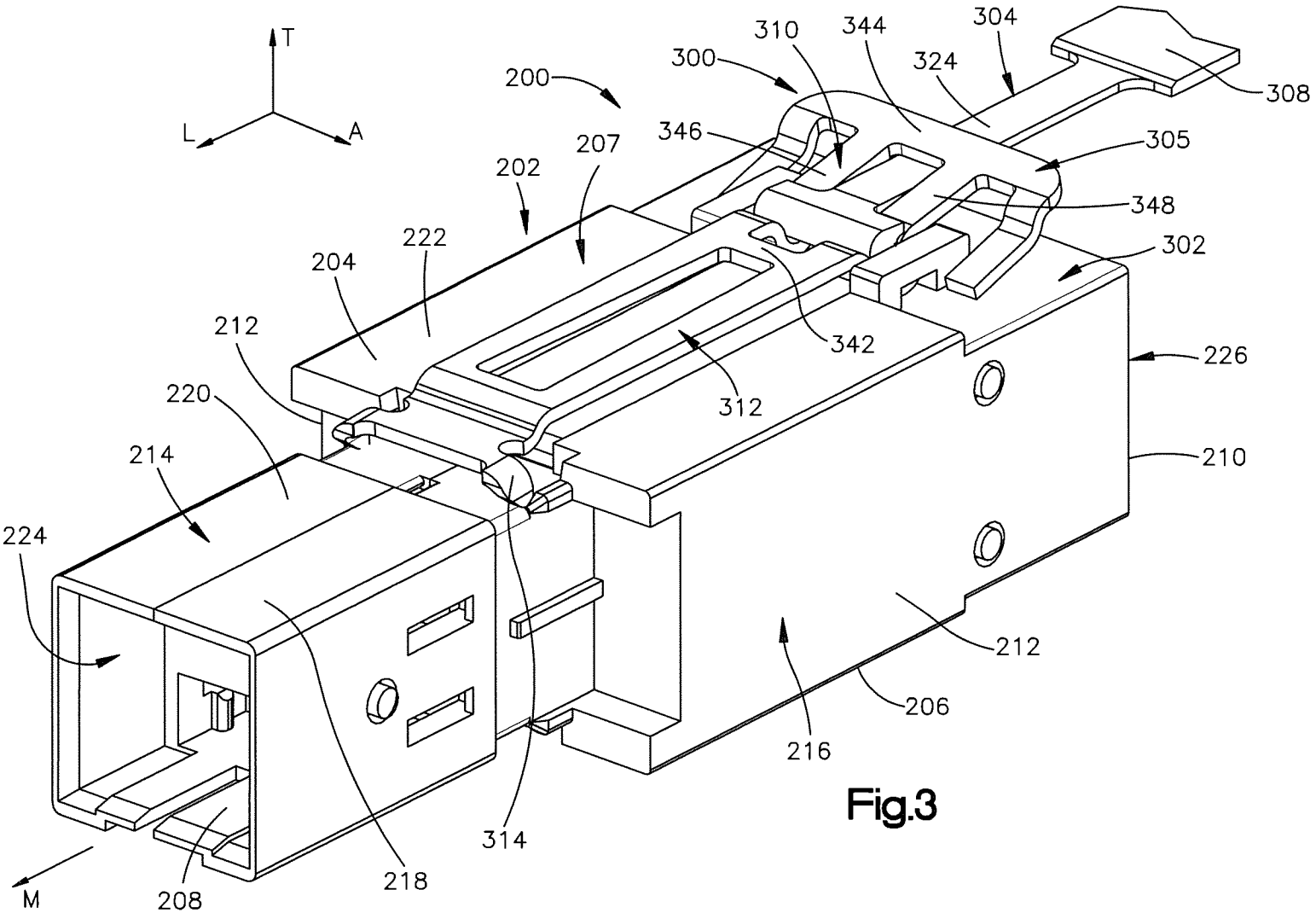
FIG. 3 is an enhanced view of the electrical connector illustrated in FIGS. 1-2, including a connector housing and a latch assembly that includes a latch and an actuator in a latched position.

Referring to FIGS. 2-3, an electrical connector 200 includes a connector housing 202 that includes at least one housing body 207. The housing body 207 defines a front end 208 and an opposed rear end 210 that is spaced from the front end 208 along a first or longitudinal direction L. The housing body 207 further defines opposed first and second sides 212 that are spaced apart from each other along a second or lateral direction A that is substantially perpendicular to the longitudinal direction L. The housing body 207 further defines a top end 204 and an opposed bottom end 206 that is spaced from the top end 204 along a third or transverse direction T that is substantially perpendicular to both the longitudinal and lateral directions L and A, respectively. In accordance with the illustrated embodiment, the transverse direction T is oriented vertically, and the longitudinal and lateral directions L and A, respectively, are oriented horizontally, although the orientation of the connector housing 202 may vary during use. The connector housing 202 can be made from any suitable dielectric material, such as plastic, or can be an electrically conductive material such as metal, and can be fabricated using any desired process.

The housing body 207 defines a first or front housing portion 214 that includes the front end 208, and a second or rear housing portion 216 that includes the rear end 210 and is disposed longitudinally behind the front housing portion 214. The front housing portion 214 can include a shroud 218 that surrounds at least one electrical contact such as a plurality of electrical conductors 232. The shroud 218 defines at least one surface, such as an upper surface 220 that is inwardly recessed with respect to an upper surface 222 of the rear housing portion 216 along the transverse direction T. The connector housing 202 defines a mating interface 224 at the front end 208 of the front housing portion 214 that can be configured to mate with a complementary electrical connector along the longitudinal direction L, and an opposed mounting interface 226 at the rear end 210 of the rear housing portion 216 that can be configured to mount to a complementary electrical component. In particular, referring to FIG. 1, the illustrated shroud 218 is configured to interface with a complementary connector housing of the complementary electrical connector so as to place the electrical conductors 232 in electrical communication with complementary electrical contacts of the complementary electrical connector. In accordance with the illustrated embodiment, the shroud 218 is configured to be received in the complementary connector housing of the complementary electrical connector.

Still referring to FIG. 1, the electrical connector 200 includes at least one electrical conductor 232 supported by the connector housing 202, and in particular supported by the housing body 207 at a location between the top end 204 and the bottom end 206. The electrical conductors 232 are configured to mate with a complementary electrical contact of a complementary electrical connector, and can be at least partially supported at the front housing portion 214 of the housing body 207. The mounting interface 226 can be provided as a ferrule 227 that extends along the longitudinal direction L from the rear end 210 of the connector housing 202. The illustrated ferrule 227 is configured to receive an electrical component in the form of cables 246 and 248 and is operably coupled to the electrical conductors 232. The illustrated ferrule 227 can be configured to allow the cables 246 and 248 to move without cracking or breaking. Thus, the ferrule 227 can also referred to as a strain relief 227 without limitation. The cables 246 and 248 can be a high-speed copper or fiber-optic cable that is in electrical communication with the electrical conductors 232 at the mating interface 224. In accordance with the illustrated embodiment, the cables 246 and 248 can be adjacent to each other along the lateral direction A, such that each of the cables 246 and 248 extend from the ferrule 227 along the longitudinal direction L, and each cable has substantially the same orientation in the transverse direction T, although other configurations are possible. Thus, an electrical connector assembly, for instance an electrical connector assembly 201, can include the electrical connector 200 and the cables 246 and 248 that are configured to be electrically connected to the electrical connector 200, or that is electrically connected to the electrical connector 200, at the mounting interface 226. For instance, the cable 246 and 248 can be power cables, data transfer cables, and in one embodiment can be fiber optic cables, such that the electrical connector 200 is configured to mate with the complementary connector in the form of an optical transceiver. While the mounting interface 226 is illustrated in FIG. 1 as including a single ferrule/strain relief 227 configured to retain a pair of cables, it should be appreciated that the mounting interface 226 can be configured to receive a single cable or more than two cables, and to operably couple the cables 246 and 248 to select ones of the electrical conductors 232 as desired. Thus, the electrical connector 200 can be electrically connected to at least one cable at the mounting interface 226. It should be further appreciated that the mounting interface 226 can be configured to place the electrical conductors 232 in electrical communication with any suitable alternative electrical component as desired.

In accordance with the illustrated embodiment, the mating interface 224 and the mounting interface 226 are oriented parallel to each other and the mating and mounting directions are parallel to each other, such that the electrical connector 200 can be referred to as a vertical connector, though it should be appreciated that the electrical connector can be configured as desired. For instance, the electrical connector 200 can be configured as a right angle connector if desired, wherein the mating interface 224 is oriented perpendicular to the mounting interface 226.

Various structures are described herein as extending horizontally along a first longitudinal direction "L" and a second or lateral direction "A" that is substantially perpendicular to the longitudinal direction L, and vertically along a third or transverse direction "T" that is substantially perpendicular to the longitudinal and lateral directions L and A, respectively. As illustrated, the longitudinal direction "L" extends along a forward/rearward direction of the connector housing 202, and thus the electrical connector 200, and defines a mating direction M along which one or both of the electrical connector 200 and a complementary electrical connector are moved relative to each other so as to mate the electrical connector 200 with the complementary electrical connector. For instance, the mating direction M of the illustrated connector housing 202, and thus the electrical connector 200, is in a forward direction along the longitudinal direction L, and the connector housing 202 can be unmated from a complementary connector housing, and thus a complementary electrical connector, by moving the connector housing 202 in an opposed longitudinally rearward direction relative to the complementary housing when the connector housing 202 is in an unlatched position. As illustrated, the lateral direction "A" extends along a width of the connector housing 202.

Thus, unless otherwise specified herein, the terms "lateral," "longitudinal" and "transverse" are used to describe the orthogonal directional components of various components. The terms "inboard" and "inner," and "outboard" and "outer" and like terms when used with respect to a specified directional component are intended to refer to directions along the directional component toward and away from the center of the apparatus being described. It should be appreciated that while the longitudinal and lateral directions are illustrated as extending along a horizontal plane, and that while the transverse direction is illustrated as extending along a vertical plane, the planes that encompass the various directions may differ during use, depending, for instance, on the orientation of the various components. Accordingly, the directional terms "vertical" and "horizontal" are used to describe the electrical connector 200 and its components as illustrated merely for the purposes of clarity and convenience, it being appreciated that these orientations may change during use.

Figure 4:
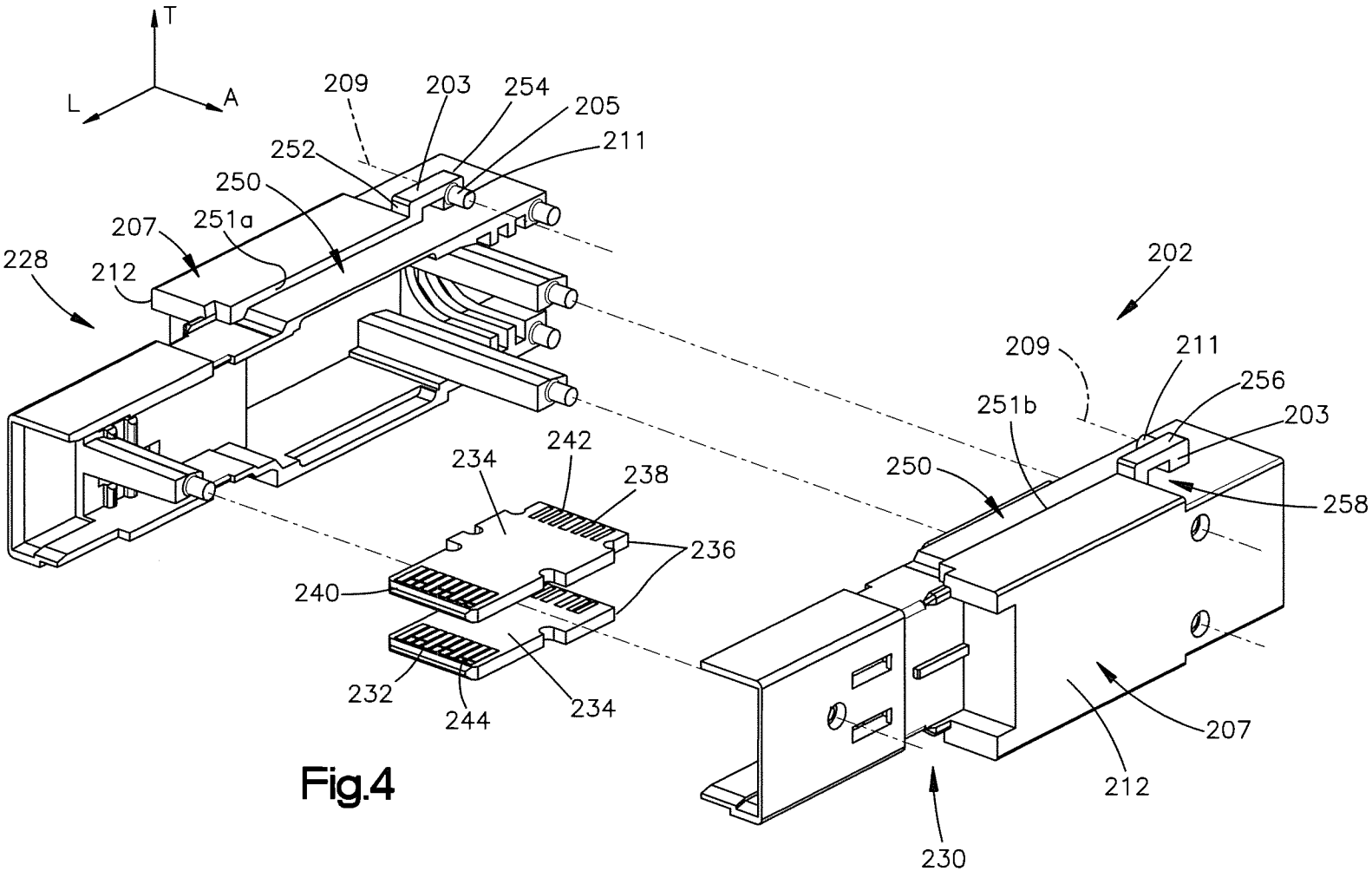
FIG. 4 is an exploded view of the connector housing illustrated in FIGS. 1-3, showing electrical contacts that are supported by the connector housing.

Referring to FIG. 4, the connector housing 202 can include a first side portion 228 and a second side portion 230 that can be joined to the first side portion 228 so as to construct the connector housing 202, though it should be appreciated that the connector housing 202 can alternatively be a monolithic structure. The electrical conductors 232 are illustrated as electrical traces that are carried by at least one substrate 234, which can be provided as one or more, such as a pair of, printed circuit boards 236. It should be appreciated, however, that the electrical conductors 232 can be alternatively configured as desired. Each printed circuit board 236 defines a first mounting end 238 and an opposed second mating end 240. The electrical conductors 232 define a first plurality of contact pads 242 at the mounting end 238, and a second plurality of contact pads 244 at the mating end 240 that are in electrical communication with the contact pads 242 at the mounting end 238. The first plurality of contact pads 242 are configured to electrically connect to the electrical component that is connected to the electrical connector 200 at the mounting interface 226, such as the cables 246 and 248. The second plurality of contact pads 244 are configured to electrically connect to the complementary electrical connector that is connected to the electrical connector 200 at the mating interface 224. For instance, the mating end 240 can be received in a receptacle of the complementary connector housing so as to place the electrical conductors 232 in electrical communication with the complementary electrical contacts.

Figure 5:
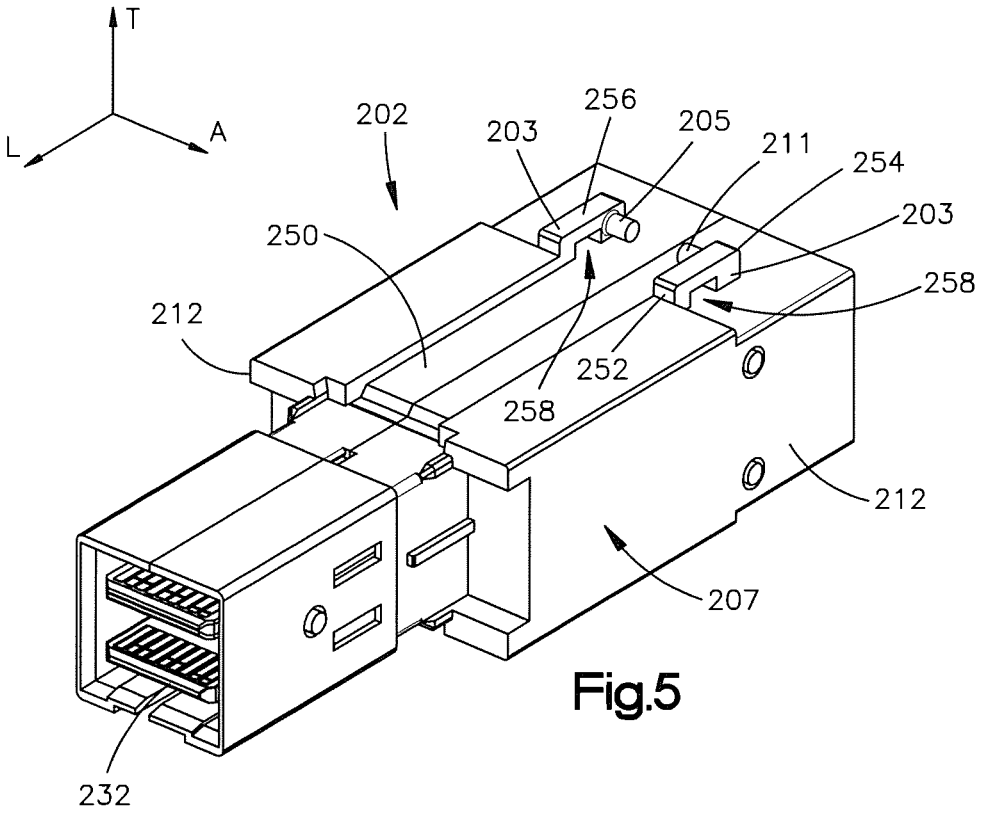
FIG. 5 is a perspective view of the connector housing illustrated in FIGS. 1-3, showing the electrical contacts that are supported by the connector housing.
Figure 6:
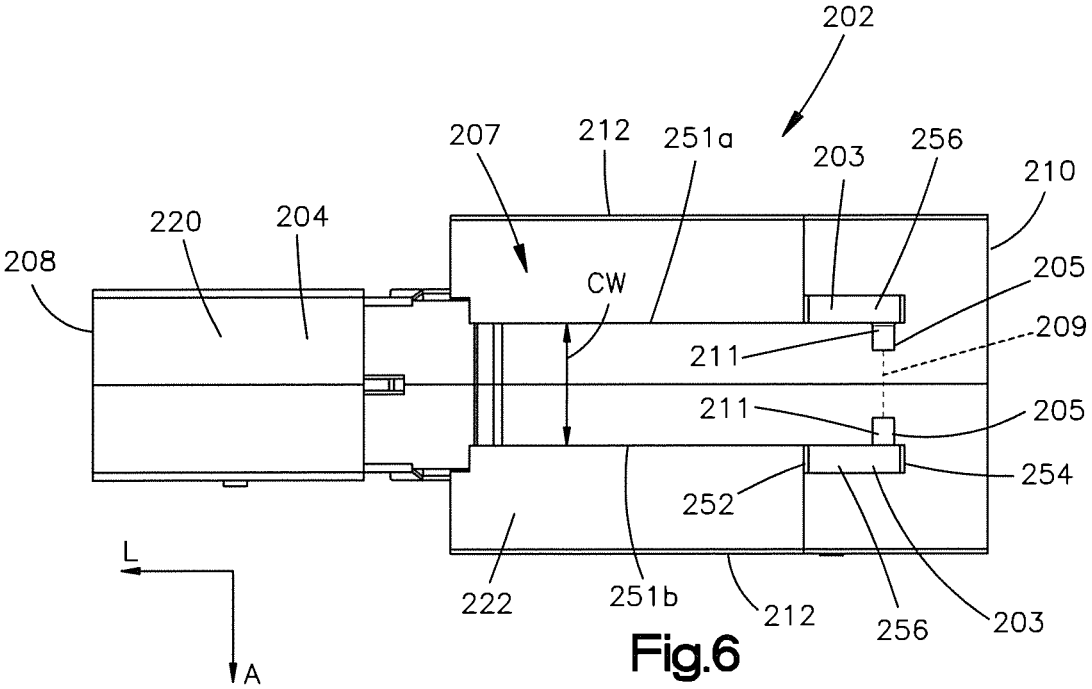
FIG. 6 is a top plan view of the connector housing illustrated in FIGS. 1-3.

Referring also to FIGS. 5-6, the connector housing 202 can include at least one fulcrum 205 supported by the housing body 207, and at least one support block 203 that is also supported by the housing body 207. For instance, the at least one fulcrum 205 and the at least one support block 203 can be monolithic with the housing body 207 or can alternatively be attached to the housing body 207 as desired. In accordance with the illustrated embodiment, the at least one support block 203 includes first and second support blocks 203 that are supported by the housing body 207. The first and second support blocks 203 can be spaced from each other along the lateral direction A, such that the first support block 203 is disposed proximate to the first side 212 and the second support block 203 is disposed proximate to the second side 212. Each of the support blocks 203 can protrude along the transverse direction T from the top end 204 of the housing body 207. Each support block 203 can include a support block body that defines a front wall 252 and an opposed rear wall 254 that is rearwardly spaced from the front wall 252 along the longitudinal direction L. The front wall 252 and the rear wall 254 extend outward from the top end 204 of the housing body 207, for instance in the transverse direction T. Further, each support block body can further define a cross-bar 256 that is connected to the front wall 252 and the rear wall 254 such that a recess 258 is at least partially defined by support block 203 and the top end 204 of the connector housing 202. The recess 258 can extend at least into or through the support block body along the lateral direction A. In the illustrated embodiment, the recesses 258 are configured as substantially rectangular apertures, although it should be appreciated that support blocks 203 can define recesses 258 having any alternative shape as desired.

In accordance with the illustrated embodiment, the at least one fulcrum 205 includes first and second fulcrums 205 that are supported by support blocks 203, and thus by the housing body 207. Each fulcrum 205 can be configured as a cylindrical body that can be elongate along the lateral direction A, and can define a central axis 209 that can extend along a direction substantially parallel to the top end 204 of the housing body 207, and can be spaced above the top end 204 of the housing body 207 in accordance with the illustrated embodiment. Each fulcrum 205 defines an outer surface 211 that can extend about the central axis 209. For instance, the outer surfaces 211 can revolve about the respective central axes 209 in accordance with the illustrated embodiment. Further, the central axes 209 of each of the fulcrums 205 can be coincident with each other. Although the illustrated embodiment shows fulcrums in a cylindrical configuration extending away from the rear wall 254 in the lateral direction A, the shape of the fulcrums, orientation of the fulcrums on the housing body 207, and number of fulcrums may vary according to various embodiments. In accordance with the illustrated embodiment, each of the first and second fulcrums 205 can be attached to the respective first and second support blocks 203, for instance to the rear walls 254, or can be spaced from the first and second support blocks 203 along one or both of the lateral direction A and the longitudinal direction L as desired.

Referring now to FIGS. 2-3, 7, 8A, and 9, the electrical connector 200 further includes a latch assembly 300 that can be configured to releasably lock the connector housing 202 to the complementary connector housing of the complementary electrical connector to which the electrical connector 200 is mated. In accordance with the illustrated embodiment, the latch assembly 300 is supported by the rear housing portion 216, and extends longitudinally forward to the front housing portion 214. Thus, the rear housing portion 216 can be said to define a latch support body 302 that supports the latch assembly 300. The latch assembly 300 can include a latch 305 and an actuator 304 that is configured to attach to the latch 305 and actuate the latch 305 to move between a latched position and an unlatched position, as will now be described.

Figure 7:
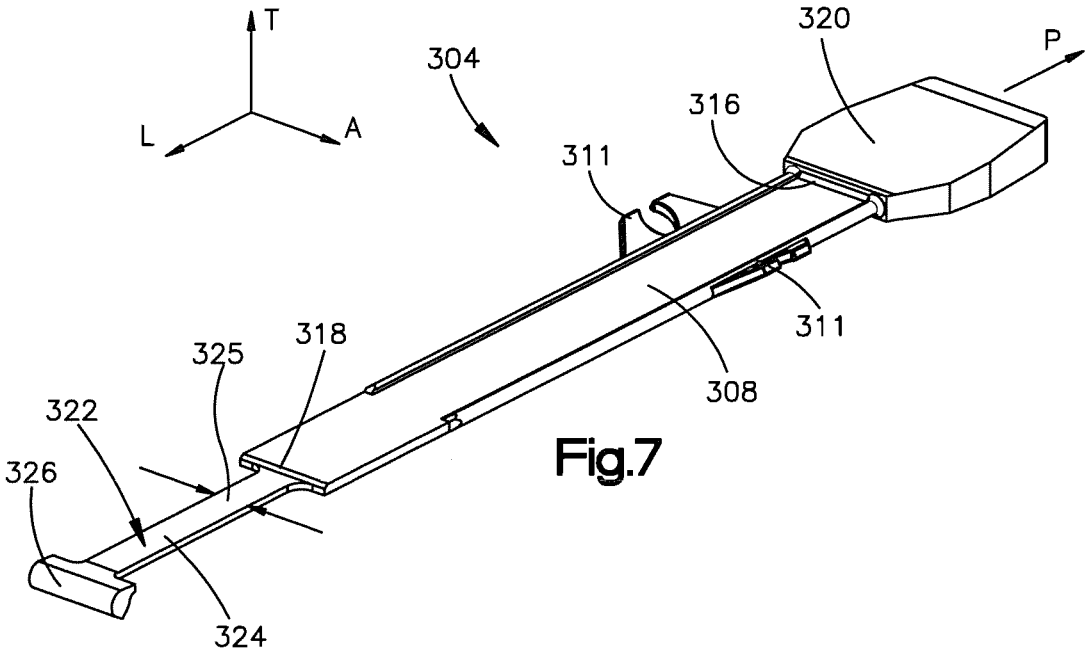
FIG. 7 is an isolated view of the actuator illustrated in FIGS. 1-3.

With particular reference to FIG. 7, the actuator 304 can define an actuator portion 320, an actuator attachment portion 322 which can be referred to as a first attachment portion, and at least one arm 308 that extends between the actuator portion 320 and the actuator attachment portion 322. The actuator 304 can further define reinforcement supports, for instance first and second reinforcement supports 311, that extend from the arm 308. In accordance with the illustrated embodiment, the first and second reinforcement supports 311 are C-shaped, although it will be understood that the first and second reinforcement supports 311 can be alternatively shaped as desired. The first and second reinforcement supports 311 can be spaced opposite each other along the lateral direction A. For instance, the first reinforcement support 311 can protrude from a first side of the arm 308 and the second reinforcement support 311 can protrude from a second side of the 308 that is opposite the first side along the lateral direction A. It will be understood that while the illustrated actuator 304 includes two reinforcement supports, the actuator 304 can be devoid of reinforcement supports or can include any number of reinforcement supports as desired. Further, while the illustrated first and second reinforcement supports 311 are proximate to the actuator portion 320, it will be understood that the reinforcement supports can be alternatively located on the actuator 304 as desired.

In accordance with the illustrated embodiment, the first and second reinforcement supports 311 can be configured to receive one or more reinforcement bands, for instance a rubber band, such that the reinforcement band wraps around the actuator 304 and the cables 246 and 248. For instance, the reinforcement band and the reinforcement supports 311 can be configured such that the reinforcement band attaches to the arm 308 and the cables 246 and 248 so that the actuator 308 is parallel to the cables 246 and 248 along the longitudinal direction L. Thus, the first and second reinforcement supports 311 can be configured to prevent one or more reinforcement bands from substantially sliding along the longitudinal direction L. It will be understood that the actuator 304 can be devoid of reinforcement supports and/or reinforcement bands as desired.

The actuator 304 can be referred to as a pull tab according to an example embodiment. The actuator attachment portion 322 of the actuator 304 can include a neck 324 and a cross-bar 326. In accordance with the illustrated embodiment, the neck 324 extends between the arm 308 and the cross-bar 326 along the longitudinal direction L, and can define a width 325 in the lateral direction A that is less than that of both the arm 308 and the cross-bar 326. The arm 308 defines a distal end 318 and a proximal end 316 that is spaced from the distal end 318 along a predetermined direction P, which can be rearward along the longitudinal direction L. Accordingly, movement of the actuator 304 along the predetermined direction P causes the latch 305 to move, for instance pivot about the fulcrum 205, along a direction from the latched position to the unlatched position. The actuator portion 320, which can be configured as a grip, extends rearward along the longitudinal direction L from the proximal end 316 of the arm 308. In this regard, the actuator 304 can be referred to as a pull tab, such that the user can grip the actuator portion 320 and apply a force that urges the actuator portion 320 to move in the predetermined direction P.

The neck 324 extends forward along the longitudinal direction from the distal end 318 of the arm 308 in a direction opposite to the predetermined direction, and the cross-bar 326 extends outward along the lateral direction A from the neck 324, for instance, from the distal end of the neck 324. The neck 324 can be flexible as desired. It should be appreciated that the directional terms "proximal" and "forward" and derivatives can refer to a direction along the longitudinal direction L from the proximal end 316 of the arm toward the distal end 318 of the arm 308. It should be further appreciated that the directional terms "distal" and "rearward" and derivatives thereof can refer to a direction along the longitudinal direction L from the distal end 318 toward the proximal end 316.

Figure 12A:
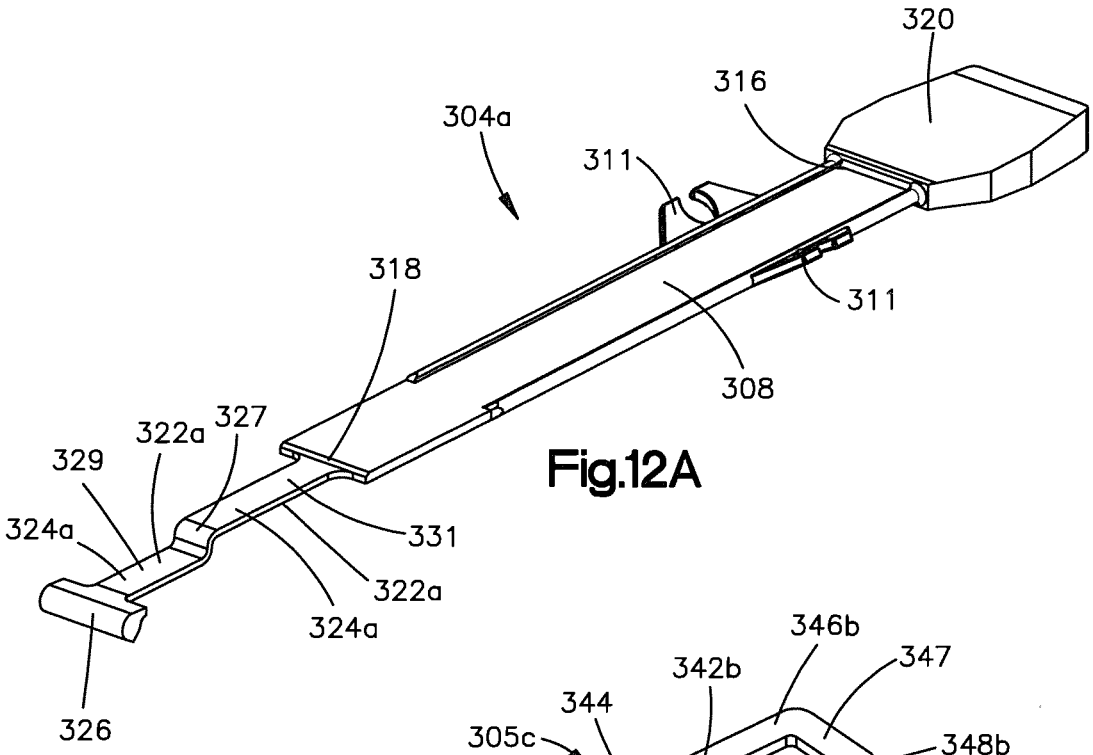
FIG. 12A is an isolated view of an actuator in accordance with another embodiment.

Continuing to refer to FIG. 7, the actuator attachment portion 322, including the neck 324 and the cross-bar 326, the arm 308, and the actuator portion 320, can all be integral and monolithic with each other. Alternatively, it should be appreciated that any one or more of the components of the actuator portion 320 can alternatively be separate from one or more other components of the actuator portion 320. For instance, referring to FIG. 12A, an actuator 304*a* can include an actuator attachment portion 322*a* that includes a neck 324*a* and the cross-bar 326 which can be separate from the arm 308 and attached to the arm 308 in any manner desired. Further, as illustrated in FIG. 12A, the neck 324*a*, and thus the actuator attachment portion 322*a*, can define an offset portion 327 such that a first neck portion 329 is offset in a downwardly transverse direction as compared to a second neck portion 331. In accordance with the illustrated embodiment, the first neck portion 329 extends rearward along the longitudinal direction L from the cross-bar 326 and the second neck portion 331 extends forward along the longitudinal direction L from the distal end 318 of the arm 308. Thus, the neck 324*a*, and thus the actuator attachment portion 322*a*, can include the first neck portion 329, the second neck portion 331, and the offset portion 327 that extends between the first and second neck portions 329 and 331 such that the first neck portion 329 is offset with respect to the second neck portion 331 along the transverse direction T that is substantially perpendicular to both the predetermined and lateral directions P and A, respectively. Further, the offset portion 327 can extend between the first neck portion 329 and the second neck portion 331 such that the cross-bar 326*a* is downwardly offset from the arm 308 along the transverse direction T. It will be understood that the offset portion 327 can be angled, curved, or alternatively shaped as desired.

Figure 8A:
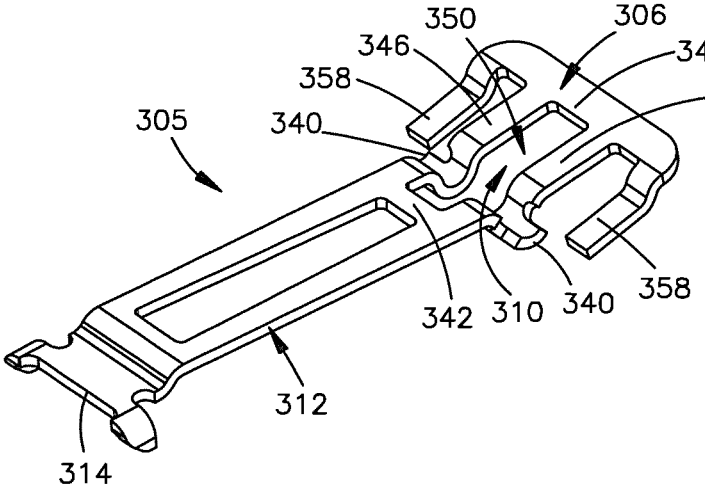
FIG. 8A is an isolated view of the latch illustrated in FIGS. 1-3.
Figure 9:
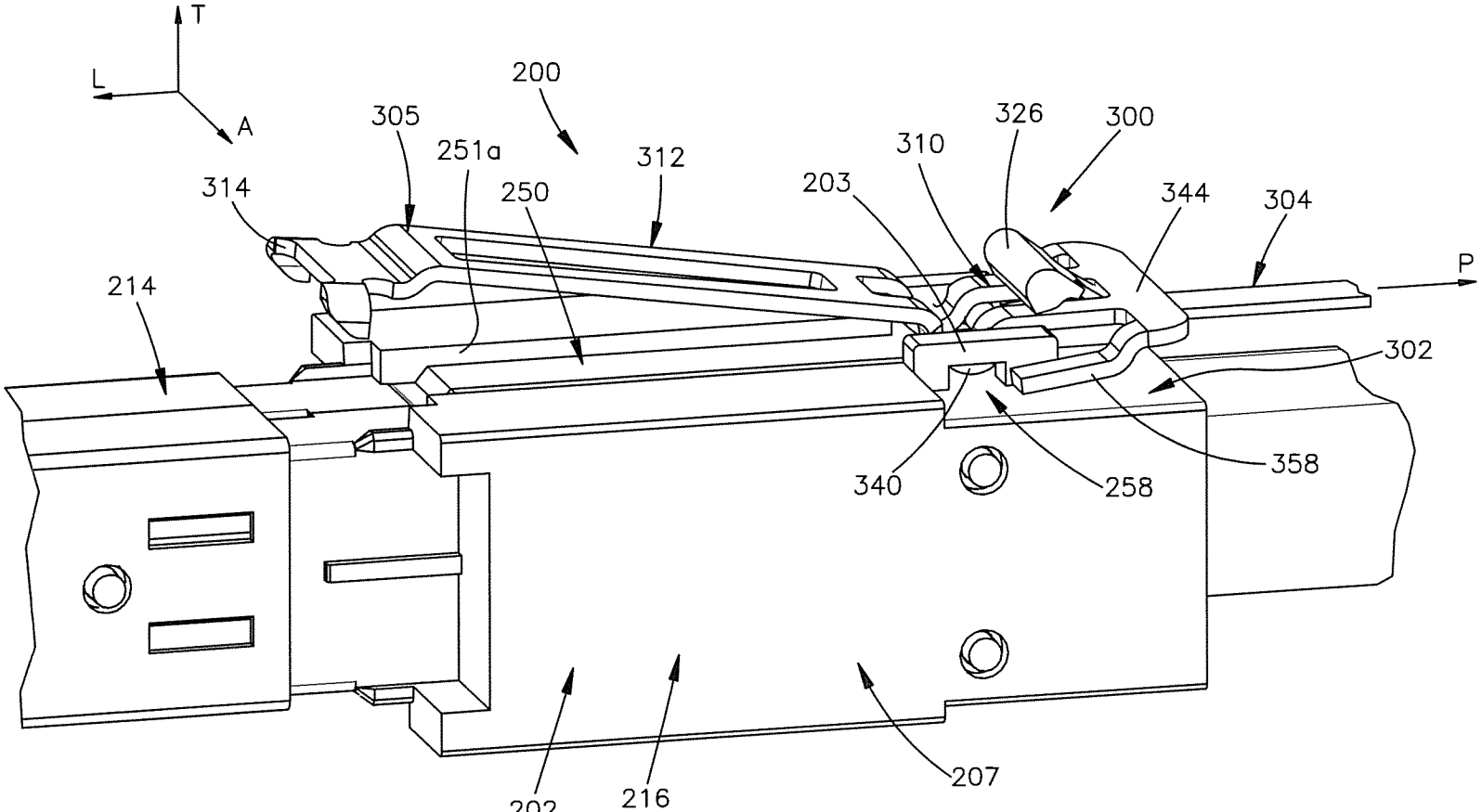
FIG. 9 is a perspective view of the connector housing and a portion of the latch assembly of FIGS. 1-3 in an unlatched position.

With particular reference to FIG. 8A, in accordance with the illustrated embodiment, the latch 305 includes a latch body 306 that defines a latch attachment portion 310, which can be referred to as a second attachment portion, that is configured to be attached to the actuator attachment portion 322 of the actuator 304. The latch body 306 further defines a latch portion 312 and at least one pivot member 340, such as first and second pivot members 340, disposed between the latch attachment portion 310 and the latch portion 312. The latch body 306 further includes a latch member 314 that extends from the latch portion 312 toward the connector housing 202. Thus, when the latch body 306 is in the latched position as shown in FIG. 3, the latch member 314 is disposed closer to the housing body 207 than when the latch body 306 is in the unlatched position as shown in FIG. 9. Accordingly, when the latch body 306 is in the latched position, the electrical connector 200 is configured to capture a complementary connector housing of the complementary electrical connector between the latch member 314 and the housing body 207, for instance between the latch member 314 and the top end 204 of the front housing 214. In accordance with the illustrated embodiment (see FIGS. 2, 8A, and 11), the cross-bar 326 can bear against the first and second pivot members 340 when the latch 305 is in the latched position. For instance, the cross-bar 326 can be substantially cylindrical and elongate in the lateral direction A, and the pivot members 340 can be rounded such that the cylindrical cross-bar 326 fits at least partially within a concave recess defined by the rounded pivot members 340 when the latch 305 is in the latched position.

Referring again to FIGS. 2-3 and 8A, the latch attachment portion includes first and second side walls 346 and 348, which also can be referred to as first and second arms 346 and 348, that are spaced apart from each other along the lateral direction A, which can be substantially perpendicular to the predetermined direction P. Thus, the latch attachment portion 310 defines a slot 350 that is defined between the first and second side walls 346 and 348 along the lateral direction A. The slot 350 extends a first distance along the lateral direction A from the first side wall 346 to the second side wall 348. The latch attachment portion 310 further includes an end wall 344 that extends from the first side wall 346 to the second side wall 348. The latch 305 can further include a second end wall 342 that extends between the front ends of the first and second side walls 346 and 348. Thus, the first and second side walls 346 and 348, and the first and second end walls 344 and 342 can at least partially define an outer perimeter of the slot 350. As described above with reference to FIGS. 2, 3, and 7, the neck 324 of the actuator 304 defines a second distance along the lateral direction A that is no greater than, for instance less than, the first distance. For instance, the width 325 of the neck 324 can define the second distance. The cross-bar 326 defines a third distance along the lateral direction A that is greater than the first distance, and thus also the second distance.

Accordingly, the neck 324 is configured to extend forward through the slot 350 such that the end wall 344 is disposed between at least a portion of the neck 324 and the cross-bar 326. As the actuator 304 is moved rearward substantially along the longitudinal direction L, the cross-bar 326 bears against at least one of the first and second arms 346 and 348 and can slide along the first and second arms 346 and 348 until the neck 324 bears against the end wall 344, at which point a rearwardly directed force is applied to the actuator 304 along the predetermined direction P, the actuator transfers the rearwardly directed force to the latch 305. Further, as the actuator 304 is moved rearward substantially along the longitudinal direction L, the cross-bar 326 can bear against at least one of the first and second arms 346 and 348 so as to apply a downwardly directed force to the latch 305.

As illustrated in FIGS. 4, 5, and 9, the rear housing portion 216, and thus the connector housing 202, defines at least one recessed latch channel 250 that extends downward into the top end 204 of the connector housing 202 in the transverse direction T. The latch channel 250 can retain at least a portion of the latch 305 when the latch 305 is in the latched position. For instance, the latch portion 312 can be disposed within the latch channel 250 when the latch 305 is in the latched position. In accordance with the illustrated embodiment, the latch channel 250 extends forward in the longitudinal direction L from the front walls 252 of the support blocks 203 to the front end of the rear housing portion 216. The connector housing 202 can further define one or more channel walls 251. In accordance with the illustrated embodiment, the connector housing 202 defines a first channel wall 251*a* and a second channel wall 251*b* that is spaced from the first channel wall 251*a* along the lateral direction A. Thus, the first and second channel walls 251*a* and 251*b* and the upper surface 222 of the rear housing portion 216 can define the latch channel 250. The latch channel 250 can retain the latch portion 312 of the latch 305 such that movement of the latch 305 along the lateral direction A is limited when the latch 305 is in the latched position. In particular, the first and second channel walls 251*a* and 251*b* can be spaced apart from each other along the lateral direction A so as to define a channel width CW (see FIG. 6) that is substantially equal to, or greater than, a width of the latch 305 along the lateral direction A. The channel width can be substantially equal to, or greater than, the third distance that the cross-bar 326 defines along the lateral direction A. For instance, the latch 305 can abut the channel walls 251*a* and 251*b* when the latch 305 is in the latched position such that the latch portion 312 is at least partially disposed in the latch channel 250. While the illustrated latch channel 250 includes channel walls 251 that are substantially parallel with respect to each other so as to form a substantially rectangular latch channel 250, it will be understood that the latch channel can be curved or alternatively shaped as desired.

With particular reference to FIG. 8A, the latch 305 can further include at least one spring 358 that extends from the latch body 306. For instance, the spring 358 can provide a spring force that biases the latch member 314 toward the latched position. The spring 358 can resiliently flex against the housing body 207 as the latch member 314 pivots from the latched position to the unlatched position. Thus, the spring 358 can deflect as the actuator 304 is moved rearward substantially along the longitudinal direction L and the cross-bar 326 slides along at least one of the first and second arms 346 and 348. The springs 358 can extend from the latch body 306 along a direction that is substantially parallel to the predetermined direction P. The springs 358 can comprise a first spring that extends from the latch body 306 along a direction that is substantially parallel to the predetermined direction P, and the latch 305 can further comprise a second spring spaced from the first spring along the lateral direction A, and the second spring can extend from the latch body 306 along a direction that is substantially parallel to the predetermined direction P. As will be understood, the spring 358 can be monolithic with the latch body 306.

Figure 10:
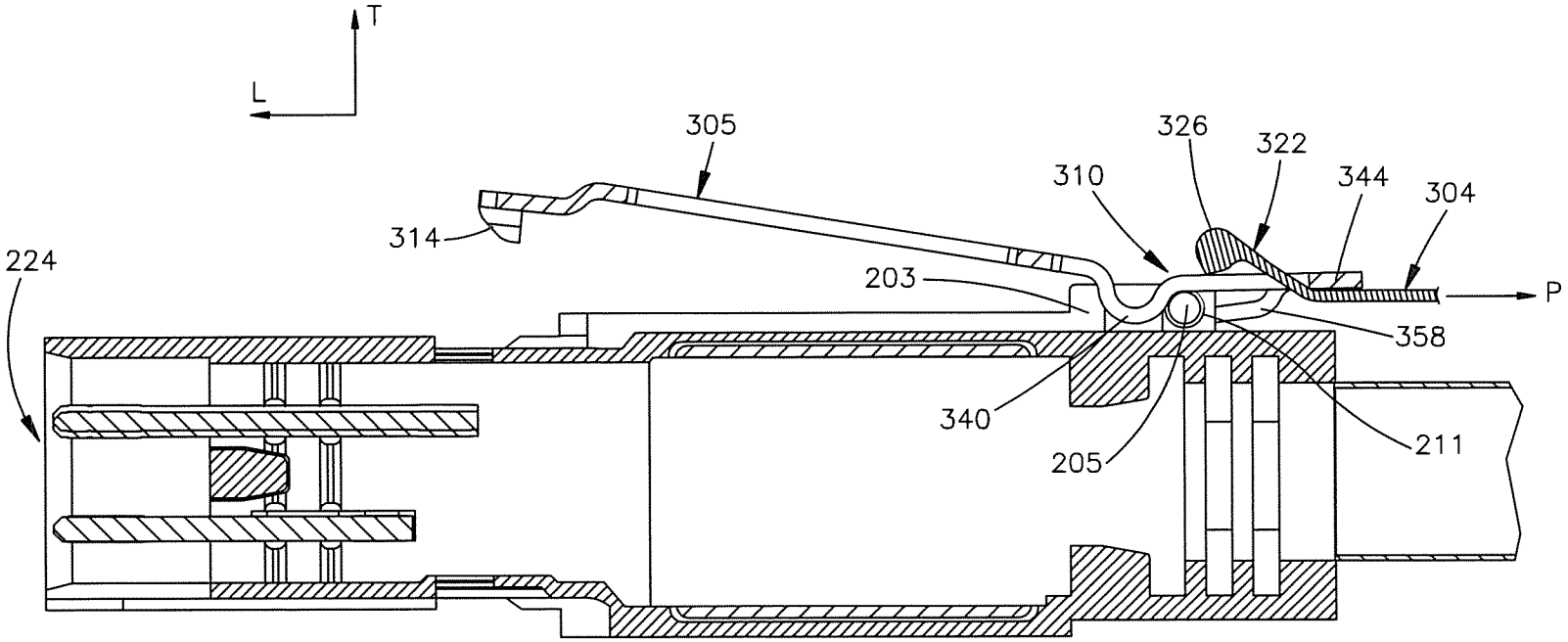
FIG. 10 is a sectional side view of the connector housing and a portion of the latch assembly of FIG. 9 in the unlatched position.
Figure 11:
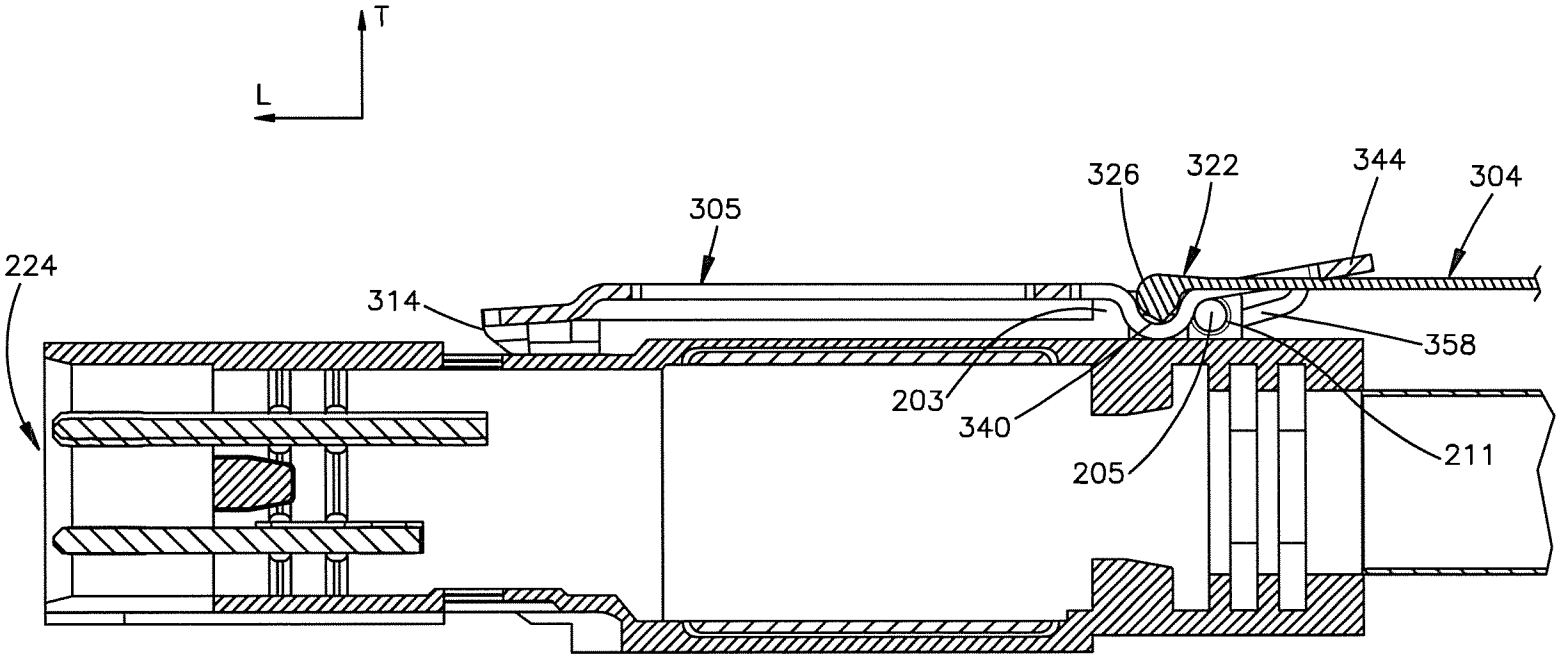
FIG. 11 is a sectional side view of the connector housing and a portion of the latch assembly of FIG. 9 in a latched position.

Referring also to FIGS. 9-11, the fulcrum 205 defines the central axis 209 that extends substantially perpendicular to the predetermined direction P, and the movement causes the pivot member 340 to revolve about the central axis 209 of the fulcrum 205. As further illustrated, the pivot member 340 defines a pivot axis, and the latch body 306 is configured to pivot about the pivot axis in response to the movement of the actuator 304, such that the pivot axis revolves about the central axis of the fulcrum. When the attachment portion 322 of the actuator 304 is attached to the attachment portion 310 of the latch 305, movement of the actuator 304 in a predetermined direction P, for instance that is rearward along the longitudinal direction L, can cause the pivot member 340 to pivot relative to the outer surface 211 of the fulcrum 205, thereby pivoting the latch 305 from the latched position to the unlatched position. For instance, the pivot member 340 can ride along the outer surface 211 of fulcrum 205 (see FIGS. 10-11), thereby pivoting the latch 305 from the latched position to the unlatched position. Thus, in accordance with one embodiment, a first location of the pivot member 340 can abut the fulcrum 205 when the latch 305 is in the latched position (see FIG. 11), and a second location of the pivot member 340 that is spaced from the first location can abut the fulcrum 205 when the latch 305 is in the unlatched position (see. FIG. 10). The first and second locations can define first and second locations of the outer surface of the pivot members 340. For instance, the fulcrum 205 can define a central axis 209 (see FIGS. 4 and 6) that extends substantially perpendicular to the predetermined direction P, and the movement causes the pivot member 340, and in particular the axis of the pivot member 340, to revolve about the central axis 209 of the fulcrum 205.

Further, the recess 258 that is defined by the support block 203 is sized to receive the pivot member 340 at a location adjacent the fulcrum 205, such that the support block 203 captures the pivot members 340 and secures the latch 305 to the connector housing 202. Thus, the pivot member 340 can be adjacent the fulcrum along the predetermined direction P when the pivot member 340 is disposed in the recess 258. For instance, each pivot member 340 can be disposed between the front wall 252 and rear wall 254 of the support block 203 along the longitudinal direction L. The pivot member 340 can abut the fulcrum 205 both when the latch 305 is in the latched position and when the latch 305 is in the unlatched position. The pivot members 340 can bear against the cross-bar 256 of the support block 340 when the latch 305 is in an unlatched position. It should be appreciated that the pivot members 340 can be spaced below the attachment portion 310. For instance, the pivot members 340 can be spaced below at least part or all of the side walls 346 and 348 along the transverse direction T, and can be spaced below the end wall 344 along the transverse direction T.

It is appreciated that the components of the latch assembly 300 can be integrally fabricated from a unitary flexible material. The flexible material facilitates bending of the actuator 304, for instance at its actuator attachment portion 322 (see FIG. 10), and in particular at its neck 324, during operation. In accordance with the illustrated embodiment shown in FIGS. 10-11, as a force is applied on the actuator 304 in the predetermined direction P so at to move the actuator 304 in the predetermined direction P, the neck 324 can flex such that the cross-bar 326 slides out of the of the concave recess defined by the pivot members 340 (see FIG. 9). As the actuator 304 moves in the predetermined direction P, the cross-bar 326 bears against at least one of the first and second arms 346 and 348 and slides along the first and second arms 346 and 348, thus translating the force in the predetermined direction P to a force that is substantially downward on the latch attachment portion 310 of the latch 305.

Figure 8B:
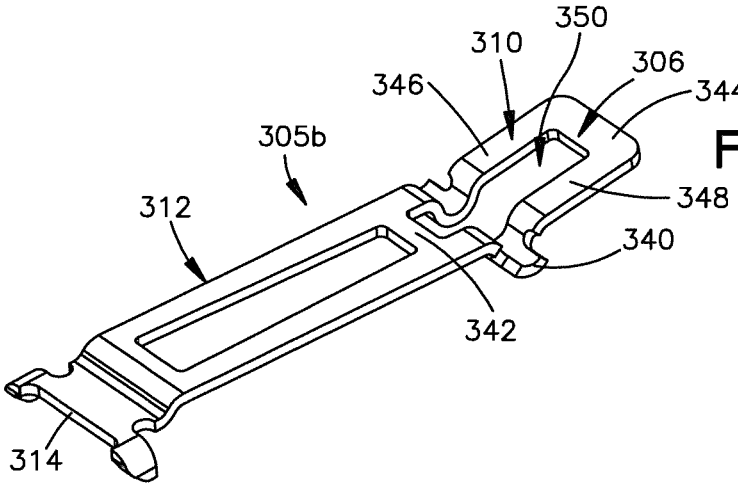
FIG. 8B is an isolated view of a latch constructed according to another embodiment.

As described above with reference to FIG. 8A, the latch 305 can include at least one spring member 358. Alternatively, the latch 305 can be devoid of the at least one spring member 358, for instance as illustrated by latches 305*b-d* in FIGS. 8B, 12B, and 12C, respectively. The latches 305*b-d* that are devoid of the spring members 358 can define a weight that biases the latch member 314 toward the latched position. For instance, the respective latch portions 312 of the latches 305*b-d* can define the weight and a length along the longitudinal direction L that biases the latch member 314 toward the latched position. Further, the support blocks 203 can abut the pivot members 340 such that, in combination with the weight of the respective latch portions 312, the latch members 314 of the latches 305*b-d* are biased toward the latched position. As illustrated in FIGS. 8A and 8B, the latch 305 and the latch 305*b* can include the latch attachment portion 310.

Figure 12B:
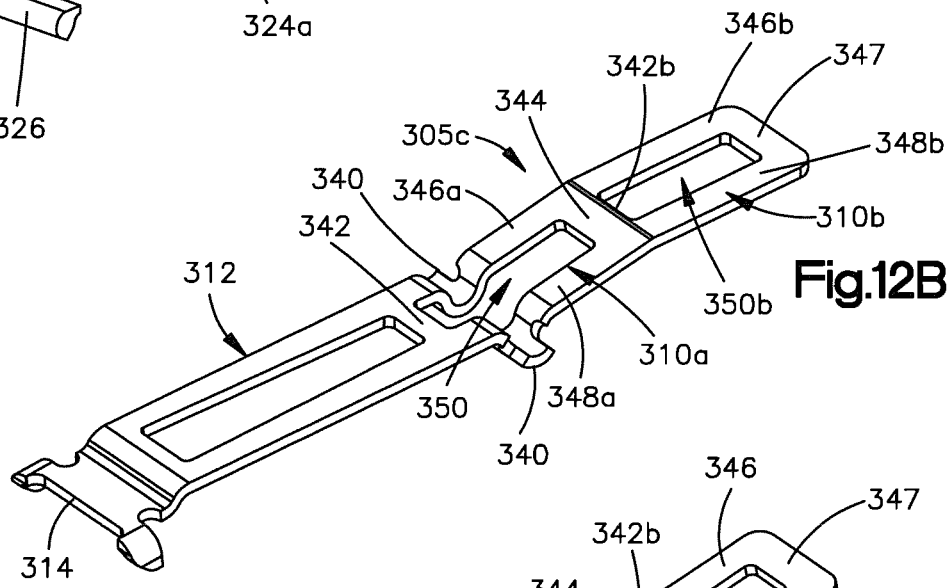
FIG. 12B is an isolated view of a latch constructed according to yet another embodiment.
Figure 12C:
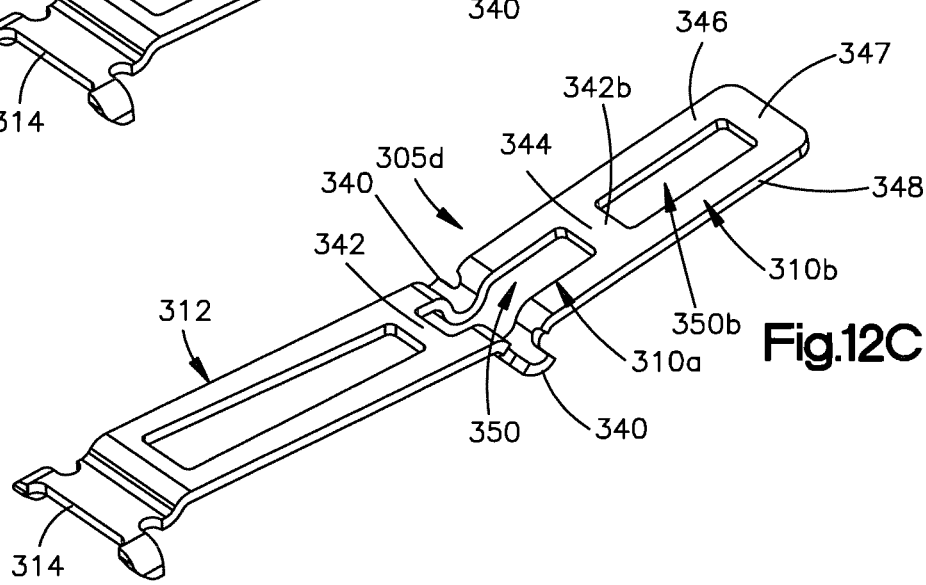
FIG. 12C is an isolated view of a latch constructed according to yet another embodiment.
Figure 13A:
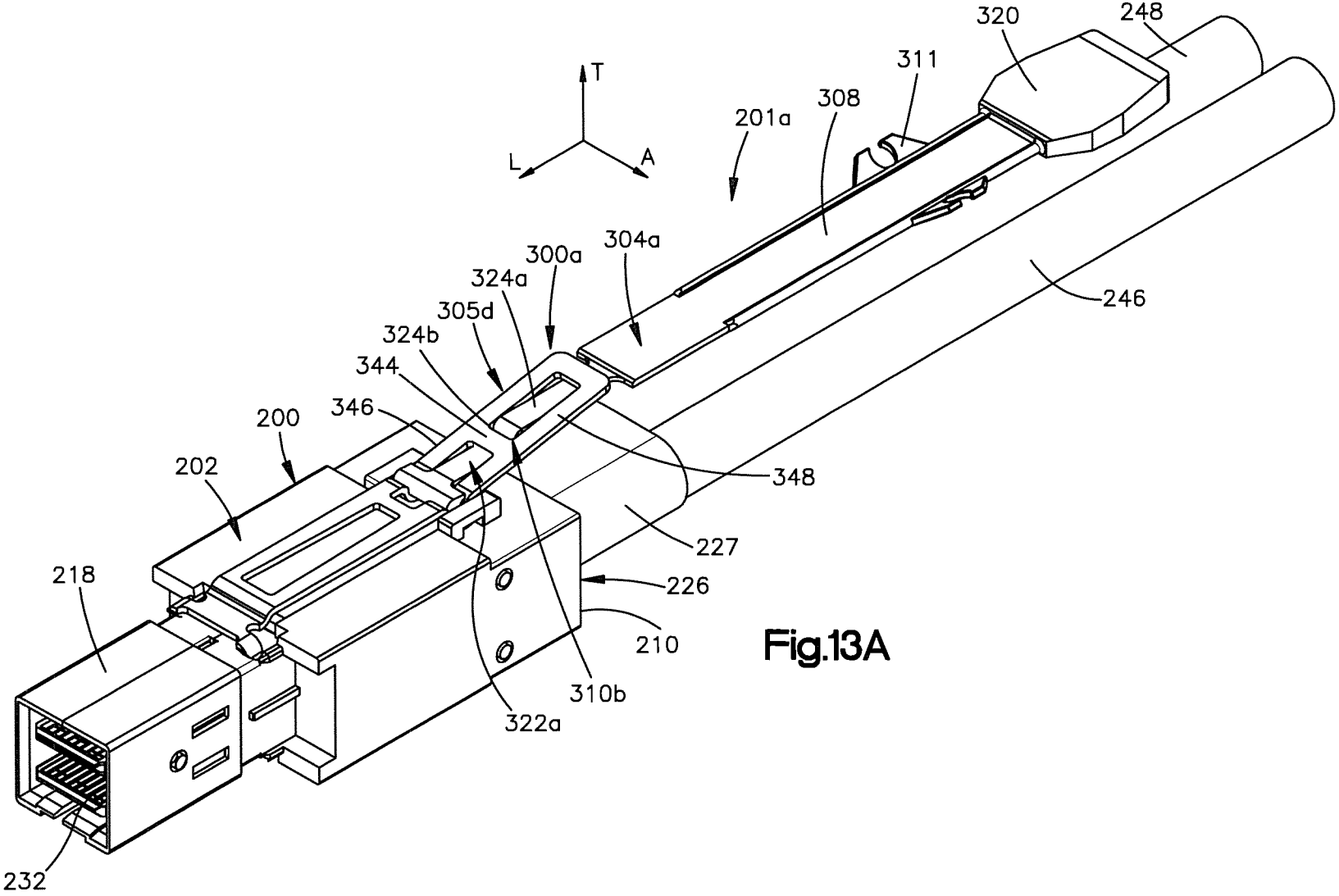
FIG. 13A is a perspective view of the pair of cables coupled to an electrical connector that includes the connector housing of FIGS. 1-6 and a latch assembly constructed according to another embodiment, wherein the latch assembly includes the actuator shown in FIG. 12A and the latch shown in FIG. 12C.
Figure 13B:
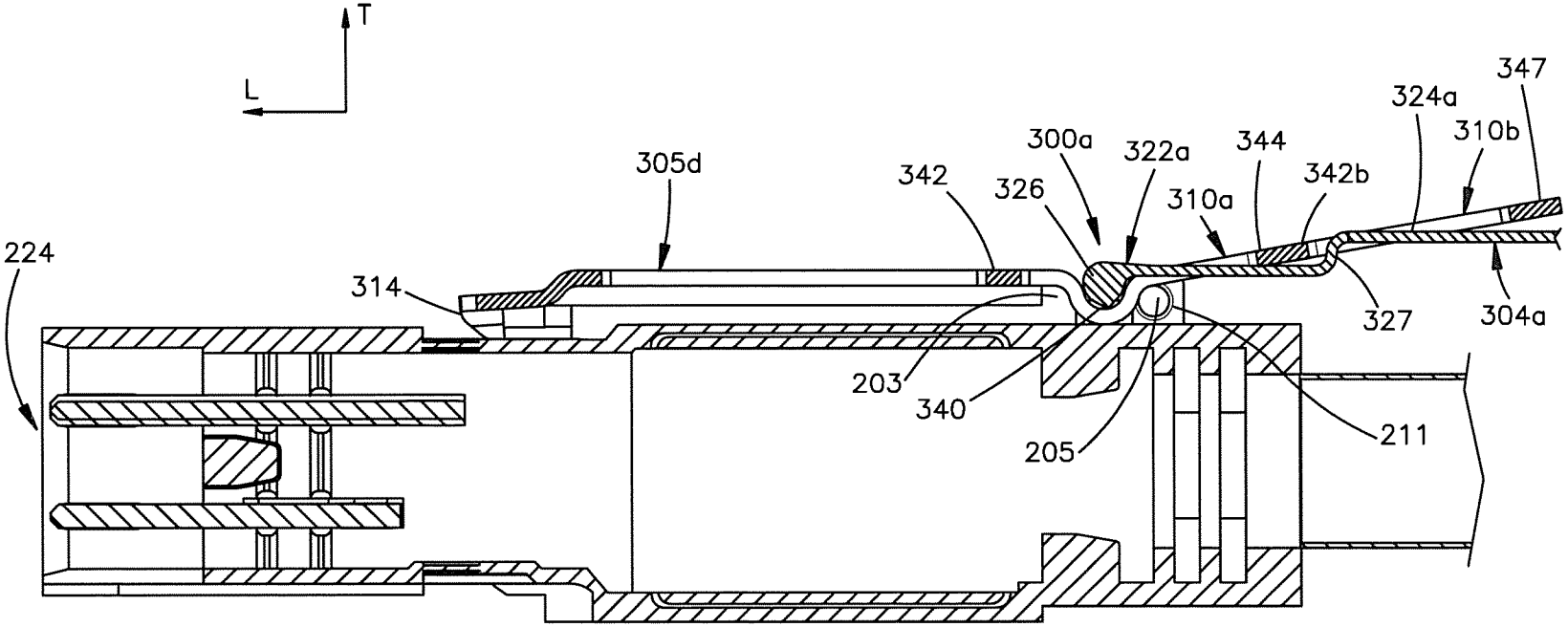
FIG. 13B is a sectional side view of the connector housing and a portion of the latch assembly of FIG. 13A in the latched position.
Figure 14A:
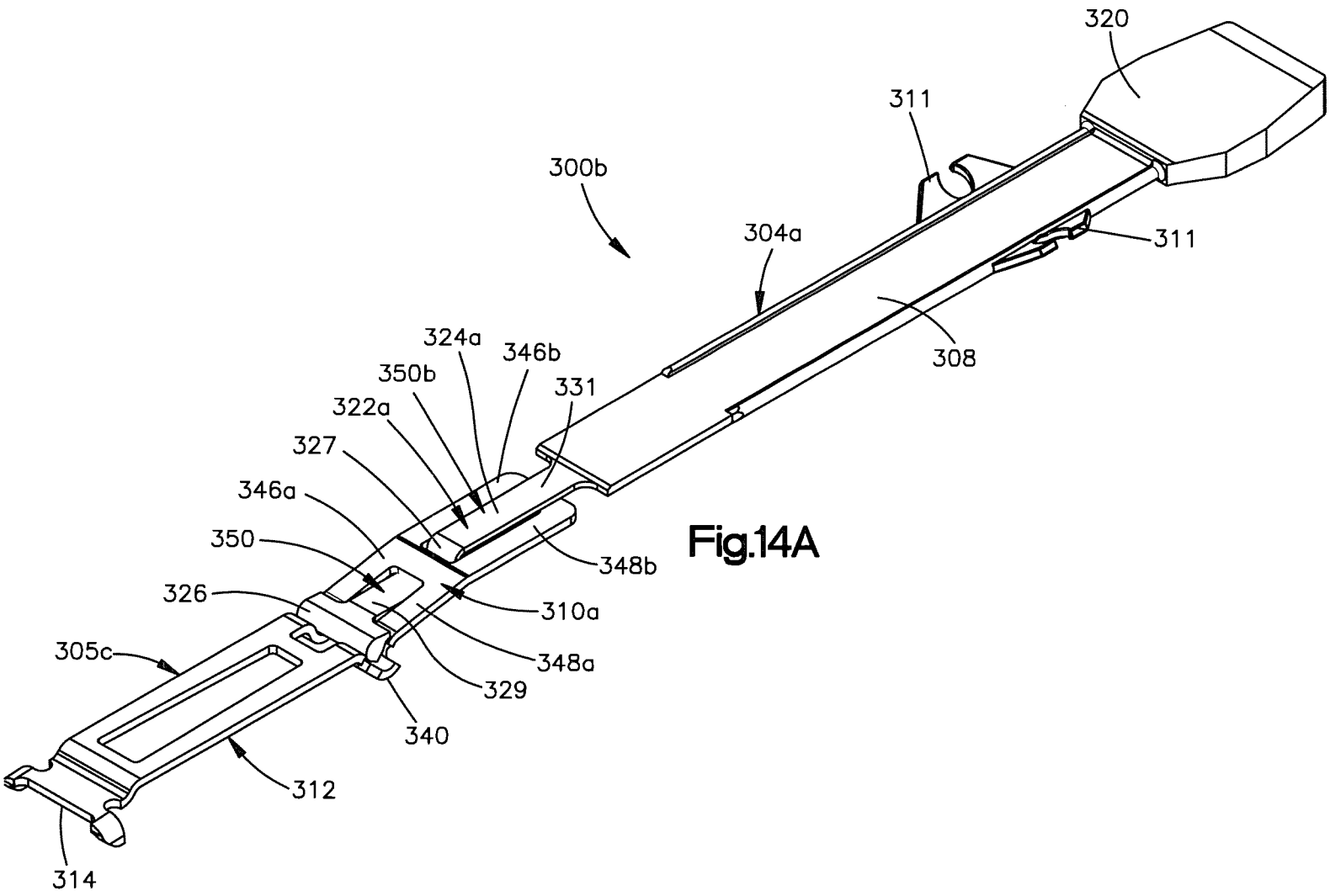
FIG. 14A is a perspective view of a latch assembly constructed in accordance with yet another embodiment, wherein the latch assembly includes the actuator shown in FIG. 12A and the latch shown in FIG. 12B.
Figure 14B:
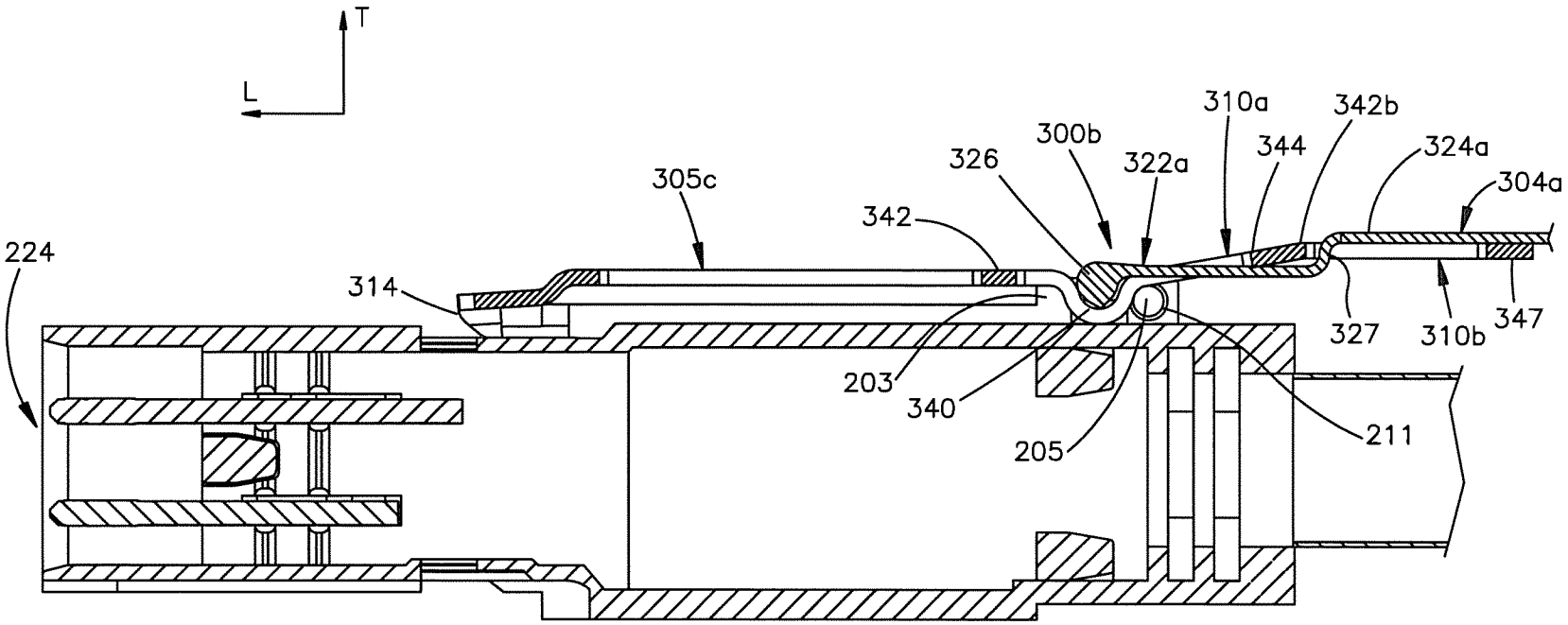
FIG. 14B is a sectional side view of the connector housing and a portion of the latch assembly of FIG. 14A in the latched position.

Referring to FIGS. 12B and 12C, the latch attachment portion 310 can be configured as a first latch attachment portion 310*a*, and the latch 305 can further include a second latch attachment portion 310*b*, for instance disposed rearward of the first latch attachment portion 310*a* along the longitudinal direction L. Thus, the latches 305*c* and 305*b* can include a respective pair of latch attachment portions 310*a* and 310*b* that are spaced from each other along the longitudinal direction L, and each of the latch attachment portions 310*a* and 310*b* can be configured to attach to the first attachment portion 322 of the actuator 304. The first latch attachment portion 310*a*, which can be referred to as the select latch attachment portion 310*a*, can be constructed as described above with respect to the latch attachment portion 310, and the second latch attachment portion 310*b*, which can be referred to as the other latch attachment portion 310*b*, can be constructed substantially identical with respect to the first latch attachment portion 310*a*, it being appreciated that the first end wall 344 of the first latch attachment portion 310*a* defines the second end wall 342*b* of the second attachment portion 310*b*. The second latch attachment portion 310*b* defines a first end wall 347 attached between the first and second side walls 346 and 348, such that the first end wall 347 is disposed rearward of the first end wall 344 along the longitudinal direction L. Accordingly, the second latch attachment portion 310*b* defines a second slot 350*b* that extends between the first and second side walls 346 and 348, and further extends between the end walls 342*b* and 347. Thus, the pair of latch attachment portions 310*a* and 310*b* are spaced from each other along the predetermined direction P, and the select latch attachment portion 310*a* of the pair of latch attachment portions defines the slot 350*b* and the other latch attachment portion 310*b* of the pair of latch attachment portions defines the second slot 350*b*.

It should be appreciated that any of the latch embodiments can attach to any of the actuator embodiments as desired so as to form various suitable latch assemblies. For instance, referring to FIG. 13A, an electrical connector assembly 201*a* includes the connector housing 202 and a latch assembly 300*a* that includes the latch 305*b* and the actuator 304*a*. It should be appreciated that the actuator attachment portion 322 of the actuator 304 can attach to either of the first and second latch attachment portions 310*a* and 310*b* as desired. For instance, referring also to FIG. 13B, the latch assembly 300*a* includes the actuator 304*a* that is attached to first latch attachment portion 300*a* of the latch 305*b*. Alternatively, referring to FIGS. 14A-14B, a latch assembly 300*b* includes the latch 305*c* and the actuator 304*a* that includes the neck 324*a* that extends through the second slot 350*b* in a first direction, and further extends through the first slot 350*a* in a second direction opposite the first direction, such that the cross-bar 326 bears against the first and second side walls 346 and 348 at the first latch attachment member 310*a*. Thus, the neck 324*a*, for instance the second neck portion 331 of the neck 324*a*, can bear against the end wall 347, for instance when the latch 305*c* is in the latched position. The pivot members 340 can be disposed closer to the first latch attachment portion 310*a* than the second latch attachment portion 310*b*.

As illustrated in FIG. 12C, the latch 305*b* can define side walls 346 and 348 that extend substantially straight between the first latch attachment portion 310*a* and the second latch attachment portion 310*b*. Alternatively, as illustrated in FIG. 12B, that latch 305*c* can define side walls 346*b* and 348*b* at the second latch attachment portion 310*b* that can be angularly offset with respect to the side walls 346*a* and 348*a* at the first latch attachment portion 310*a*. For instance, the side walls 346*a* and 348*a* at the first latch attachment portion 310*a* can extend up and away from the housing body 207 (see FIG. 14B) along the transverse direction T as they extend rearward along the longitudinal direction L with respect to the side walls 346*b* and 348*b* at the second latch attachment portion 310*b*.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. For instance, while the latch body 306 and the actuator 304 are discretely connected in accordance with the illustrated embodiment, the latch body 306 and the actuator 304 can alternatively be integral with each other. Furthermore, while the latch body 306 is discretely attached to the connector housing 202 in accordance with the illustrated embodiment, it should be appreciated that the latch body 306 can alternatively be integral with the connector housing 202.

What is claimed:

1. An electrical connector comprising:

a connector housing including a housing body and further including at least one fulcrum supported by the housing body;

at least one electrical contact supported by the connector housing, the at least one electrical contact configured to mate with a complementary electrical contact of a complementary electrical connector; and a latch assembly including:

an actuator having an actuator portion, a first attachment portion, and at least one arm that extends between the actuator portion and the first attachment portion; and a latch having a latch body that defines a second attachment portion that is configured to be attached to the first attachment portion, a latch portion, and at least one pivot member disposed between the second attachment portion and the latch portion, wherein the latch body further includes a latch member that extends from the latch portion toward the connector housing, wherein when the first attachment portion is attached to the second attachment portion, movement of the actuator in a predetermined direction causes the pivot member to move along the fulcrum, thereby pivoting the latch from a latched position to an unlatched position.

2. The electrical connector as recited in claim 1, wherein the fulcrum defines a central axis that extends substantially perpendicular to the predetermined direction, and the movement causes the pivot member to revolve about the central axis of the fulcrum.

3. The electrical connector as recited in claim 2, wherein the pivot member defines a pivot axis, and the latch body is configured to pivot about the pivot axis in response to the movement of the actuator, such that the pivot axis revolves about the central axis of the fulcrum.

4. The electrical connector as recited in claim 1, wherein when the latch body is in the latched position, the latch member is disposed closer to the housing body than when the latch body is in the unlatched position.

5. The electrical connector as recited in claim 1, wherein the latch further comprises a spring that extends from the latch body, the spring providing a spring force that biases the latch member toward the latched position.

6. The electrical connector as recited in claim 5, wherein the spring resiliently flexes against the connector housing as the latch member pivots from the latched position to the unlatched position.

7. The electrical connector as recited in claim 6, wherein the spring extends from the latch body along a direction that is substantially parallel to the predetermined direction.

8. The electrical connector as recited in claim 6, wherein the spring is a first spring, the latch further comprises a second spring that extends from the latch body along a direction opposite that of the first spring.

9. The electrical connector as recited in claim 5, wherein the spring is monolithic with the latch body.

10. The electrical connector as recited in claim 1, wherein:

the second attachment portion comprises first and second side walls that are spaced apart along a lateral direction that is substantially perpendicular to the predetermined direction so as to define a slot between the first and second side walls and a first distance that extends along the lateral direction through the slot from the first side wall to the second side wall; and the first attachment portion comprises 1) a neck that extends along the lateral direction a second distance that is no greater than the first distance, and 2) a cross-bar that extends from the neck so as to define a third distance along the lateral direction that is greater than the first distance, such that the neck is configured to extend through the slot such that the cross-bar bears against at least one of the first and second arms during the movement of the actuator.

11. The electrical connector as recited in claim 10, wherein the second attachment portion further comprises an end wall connected between the first and second side walls, such that the cross-bar further bears against the end wall during the movement of the actuator.

12. The electrical connector as recited in claim 1, further comprising at least one support block that extends from the housing body, the support block defining a recess that is sized to receive the pivot member at a location adjacent the fulcrum.

13. The electrical connector as recited in claim 12, wherein the pivot member is adjacent the fulcrum along the predetermined direction when the pivot member is disposed in the recess.

14. The electrical connector as recited in claim 13, wherein the pivot member abuts the fulcrum both when the latch is in the latched position and when the latch is in the unlatched position.

15. The electrical connector as recited in claim 14, wherein a first location of the pivot member abuts the fulcrum when the latch is in the latched position, and a second location of the pivot member that is spaced from the first location abuts the fulcrum when the latch is in the unlatched position.

16. The electrical connector as recited in claim 1, wherein the latch comprises a pair of attachment portions that are spaced from each other along the predetermined direction, each of the attachment portions configured to attach to the first attachment portion.

17. The electrical connector as recited in claim 10, wherein the latch comprises a pair of attachment portions that are spaced from each other along the predetermined direction, a select one attachment portion of the pair of attachment portions defines the slot and the other attachment portion of the pair of attachment portions defines a second slot.

18. The electrical connector as recited in claim 17, wherein the neck extends through the second slot in a first direction and extends through the slot in a second direction opposite the first direction such that the cross-bar bears against the first and second side walls of the select one attachment member.

19. The electrical connector as recited in claim 17, wherein the pivot member is disposed closer to the select one attachment portion than the other attachment portion.

20. An electrical connector comprising:

a connector housing;

at least one electrical contact supported by the connector housing, the at least one electrical contact configured to mate with a complementary electrical contact of a complementary electrical connector; and a latch assembly including:

a latch having a latch body that defines a latch attachment portion, a latch portion, and at least one pivot member disposed between the latch attachment portion and the latch portion, wherein the latch body further includes a latch member that extends from the latch portion toward the connector housing, the latch attachment portion including first and second side walls that are spaced apart so as to define a slot therebetween;

an actuator having an actuator portion, an actuator attachment portion, and at least one arm that extends between the actuator portion and the actuator attachment portion, the actuator attachment portion including a neck, and a cross-bar that extends from the neck, such that the neck is configured to extend through the slot so that the cross-bar bears against at least one of the first and second arms, thereby attaching the actuator attachment portion to the latch attachment portion;

wherein when the actuator attachment portion is attached to the latch attachment portion, movement of the actuator in a predetermined direction causes the pivot member to pivot the latch from a latched position to an unlatched position, whereby the latch member is disposed closer to the connector housing when the pivot member is in the latch position with respect to when the pivot member is in the unlatched position.

21. The electrical connector as recited in claim 20, wherein 1) the first and second side walls of the latch attachment portion are spaced apart a first distance along a lateral direction that is substantially perpendicular to the predetermined direction, 2) the neck extends along the lateral direction a second distance that is no greater than the first distance, and 3) the cross-bar defines a third distance along the lateral direction that is greater than the first distance.

22. The electrical connector as recited in claim 20, wherein the latch attachment portion further comprises an end wall connected between the first and second side walls, such that the cross-bar further bears against the end wall during the movement of the actuator.

23. The electrical connector as recited in claim 20, wherein the latch comprises a pair of latch attachment portions that are spaced from each other along the predetermined direction, each of the latch attachment portions configured to attach to the actuator attachment portion.

24. The electrical connector as recited in claim 23, wherein the pair of latch attachment portions are spaced from each other along the predetermined direction, a select latch attachment portion of the pair of latch attachment portions defines the slot and the other latch attachment portion of the pair of latch attachment portions defines a second slot.

25. The electrical connector as recited in claim 24, wherein the slot is a first slot, and the neck extends through the second slot in a first direction and extends through the first slot in a second direction opposite the first direction such that the cross-bar bears against the first and second side walls of the select latch attachment member.

26. The electrical connector as recited in claim 25, wherein the pivot member is disposed closer to the select latch attachment portion than the other latch attachment portion.

27. The electrical connector as recited in claim 24, wherein the first and second side walls extend substantially straight between the each of the pair of latch attachment portions.

28. The electrical connector as recited in claim 24, wherein the first and second side walls at the select latch attachment portion are angularly offset with respect to the first and second side at the other latch attachment portion.

* * * * *